United States Patent [19]

Harding et al.

[11] Patent Number: 4,667,732

[45] Date of Patent: May 26, 1987

[54] HEAT EXCHANGER TUBE CLEANING SYSTEM

[76] Inventors: Paul J. Harding, 140 Lindsey Ave., Buchanan, N.Y. 10511; K. Peter Koch, 108 Midway Ave., Locust Valley, N.Y. 11560

[21] Appl. No.: 751,985

[22] Filed: Jul. 5, 1985

[51] Int. Cl.[4] ..... F28G 1/02; F28G 1/12

[52] U.S. Cl. ..... 165/95; 15/3.51

[58] Field of Search ..... 165/95; 15/3.51

[56] References Cited

U.S. PATENT DOCUMENTS

| | | | |
|---|---|---|---|
| 3,319,710 | 5/1967 | Heeren et al. | 165/95 |
| 4,415,022 | 11/1983 | Baron et al. | 15/3.51 X |
| 4,489,776 | 12/1984 | Baron | 165/95 |
| 4,544,026 | 10/1985 | Baron | 165/95 |

FOREIGN PATENT DOCUMENTS

| | | | |
|---|---|---|---|
| 1018524 | 1/1966 | United Kingdom | 165/95 |

*Primary Examiner*—Albert W. Davis, Jr.

*Assistant Examiner*—Peggy Neils

*Attorney, Agent, or Firm*—Burton E. Levin

[57] ABSTRACT

Apparatus is disclosed which is attached to the ends of a heat exchanger tube to capture a tube cleaning brush or sponge that has been propelled back and forth through the tube by reversing the direction of flow of the circulating cooling fluid. The apparatus includes a tubular synthetic polymer cage with perforated walls which receives the expelled cleaning element and holds it in alignment with the tube and a tandemly positioned tubular synthetic polymer adapter which is bonded at one end to an open end of the tube and which functions as a conduit for the movement of the cooling fluid and cleaning element between the tube and cage. The adapter and cage are coupled through lockable mating open ends which permit the cage to be removed manually and non-destructively, thereby providing fast and unobstructed access to the interior of the tube by test probes. A particularly secure coupling also is disclosed in which these mating open ends are the male and female elements of a snap fastener.

17 Claims, 3 Drawing Figures

HEAT EXCHANGER TUBE CLEANING SYSTEM

BACKGROUND OF THE INVENION

1. Field of the Invention

This invention relates to cleaning heat exchanger tubes. More particularly, it relates to improved apparatus that is coupled to the ends of a heat exchanger tube to capture a brush or sponge that is propelled back and forth through the tube by reversible fluid pressure.

2. Description of the Prior Art

A common type of heat exchanger has a bundle of tubes which are fixed at their ends in headers or tube sheets. Water or other fluid flows from a common water box or reservoir on one end of the bundle through the tubes to a second common water box or reservoir at the other end of the bundle. Heat exchange is effected through the heat conductive walls of the tubes between the fluid in the tubes and a different temperature water or other fluid on the outside of the tubes. Exemplary of such heat exchangers are the condensors that are widely employed to dispell or recover heat from waste process steam in industrial and electric generating plants. In these condensors, cooling water, which often is untreated, is pumped through the tubes to condense the steam on the outer surface of the tubes. As is well known, if the cooling water is untreated or inadequately treated to prevent the precipitation of dissolved minerals, a mineral deposit will gradually accumulate on the inside of the tubes.

Such mineral deposit, which is commonly known as scale, impairs heat exchange efficiency and may lead to corrosion of the tubes. It must, therefore, be removed regularly. An effective means of doing so is to employ the circulating cooling water to propel a cleaning element, such as a tube brush or sponge, through each tube to dislodge the deposit and permit it to become suspended in the water and carried away in the discharge.

U.S. Pat. No. 3,319,710 describes a tube cleaning system which is applicable to condensors or other heat exchangers in which the cooling water flow is reversible. An elongated brush is placed within each tube and a tubular monolithic molded synthetic resin chamber, which has an inside diameter that is less than the length of the brush, is attached to each end of the tube to capture the expelled brush and hold it in remote alignment with its tube until the water flow is reversed. Water passes through the chamber via perforations in its wall and through an opening, which is restricted to prevent passage by the brush, in the end of the chamber distal from the heat exchanger tube. When the water flow is reversed, the brush is driven back into and through the heat exchanger tube and is captured in the chamber at the opposite end.

A major disadvantage of this system is the fact that the restricted end of the chamber does not permit easy insertion of an electronic probe into the heat exchanger tube to test the tube wall integrity, as required by modern maintenance practice for heat exchangers. When these monolithic plastic chambers are cemented to the heat exchanger tube, as is customary with non-cupreous tubes, the most practical way that this maintenance can be done is to break the chamber away and replace it with a new one when the test is completed.

One means of avoiding this problem is disclosed in U.S. Pat. No. 4,124,065, which describes a thin metal brush capturing chamber that is expanded with a roller expander into leakproof engagement with the end of a heat exchanger tube. Access to the tube is provided by a removable restriction in the end of the chamber distal from the tube. While this eliminates the necessity of replacing the brush catching chambers after each test, it is awkward and difficult to pass a probe through the thin metal chamber without bending that chamber or damaging the probe on its sharp edges. In addition, there is a substantial risk of damage to the end of the heat exchanger tube when it does become necessary to remove a bent or otherwise damaged chamber and expand a new chamber into that tube.

A second means of avoiding the necessity of replacing brush capturing chambers after each tube test also is disclosed in U.S. Pat. No. 4,124,065. This second means utilizes a thin metal thimble, one end of which is expanded with a roller expander into leakproof engagement with a heat exchanger tube. A thread is formed at the other end of the thimble with a thread roller. The brush capturing chamber is a helically wound wire cage having one fully open end that can be screwed onto the thimble thread. While this removable wire cage eliminates the awkwardness of passing a probe through a thin metal brush capturing chamber, the probe is still subject to damage by the sharp edge at the threaded end of the thimble. The thin metal thimble also must be replaced frequently as it is easily dented or otherwise distorted by insertion of the probe or by repeated removal and reinstallation of the wire cage. The risk of damage to the end of the heat exchanger tube in expanding a replacement thimble into it is undiminished. In addition, the threaded coupling of the thimble and wire cage often becomes loosened by vibrations normally occurring in an operating heat exchanger, which may lead to loss of the cage and brush in the water box.

SUMMARY OF THE INVENTION

It is an object of this invention to provide improved means for cleaning a heat exchanger tube through which the fluid flow can be reversed. It is a specific object to provide durable and easily fabricated and installed means for capturing a tube cleaning element that is propelled by fluid pressure through and out an end of a heat exchanger tube and for holding that cleaning element aligned remotely with that tube end until the fluid flow is reversed and the cleaning element is back into and through the tube. It is a further specific object to provide such cleaning element capturing means which can be securely fastened to the end of a heat exchanger tube without risk of damage to that tube and which can easily and quickly be disassembled so that an electronic probe can be inserted into the interior of the tube without obstruction or risk of damage to that probe.

These objects and other advantages, which will be apparent from this specification, are achieved by the invention described below.

One aspect of our invention is demountable apparatus for capturing a solid cleaning element that has been propelled by fluid pressure through a heat exchanger tube comprising a perforated tubular cage for catching said cleaning element and a tubular adapter for conveying said cleaning element between said heat exchanger tube and said cage, said cage having a first open end which is restricted to obstruct the passage of said cleaning element and a second open end through which said cleaning element can pass, said adapter having a first open end adapted for fluid communication with said heat exchanger tube and a second open end adapted for fluid communication with said second open cage end and said second open cage and adapter ends being mating elements of a snap fastener.

Another aspect of our invention is a heat exchanger having a plurality of heat exchanger tubes extending between reservoirs common to said tubes, means for reversing the fluid flow through said tubes and tube cleaning means comprising a cleaning element in each said tube and, at each end of each such tube, a tandemly positioned tubular synthetic polymer cage for catching said cleaning element and an intermediate synthetic polymer adapter for conveying said cleaning element between said heat exchanger tube and said cage, said cage having a plurality of longitudinal slots in its wall, a first open end which is restricted to obstruct the passage of said cleaning element by at least one inward protrusion from said wall and a second open end through which said cleaning element can pass, said adapter having a first open end in fluid communication with and bonded to an end of said heat exchanger tube and a second open end in fluid communication with and lockably coupled to said second open cage end.

DESCRIPTION OF THE PREFERRED EMBODIMENTS

Figure 1:
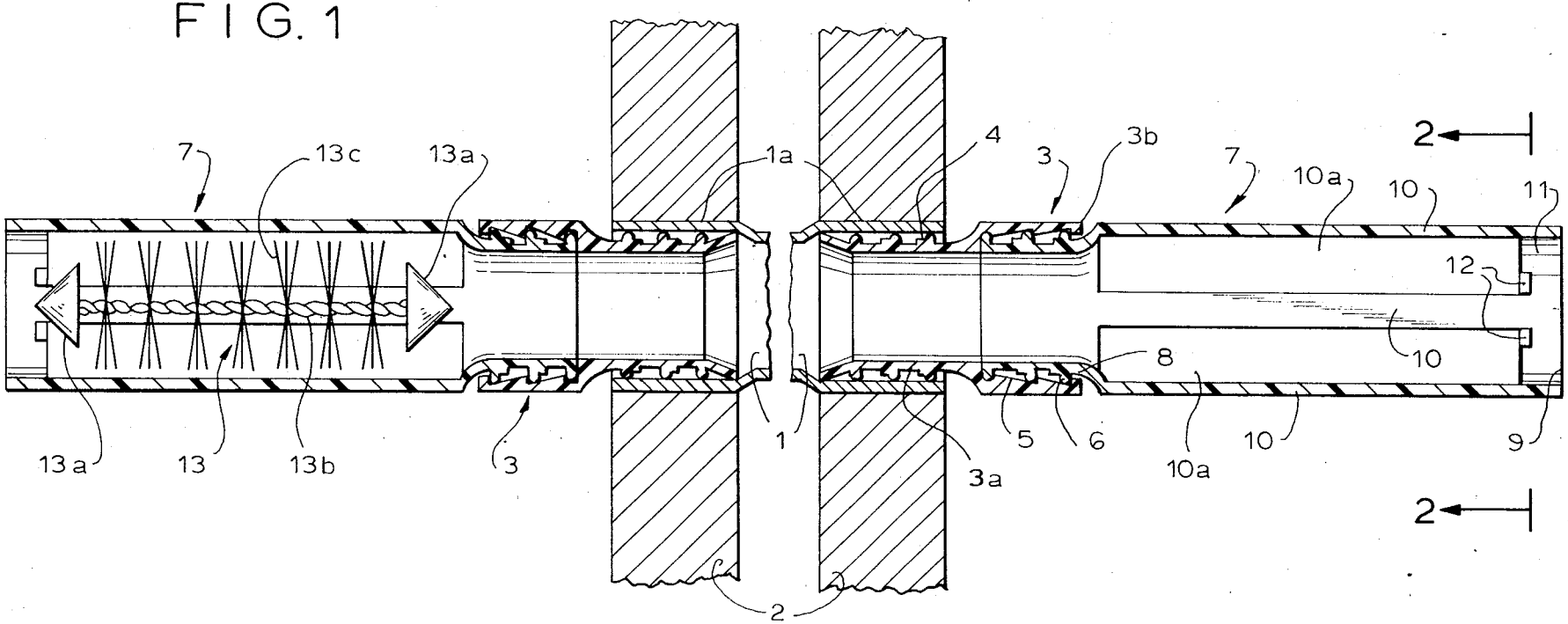
FIG. 1 is a longitudinal cross-section through a heat exchanger tube which is flush mounted in fragmentarily shown tube sheets and which supports, at each end, a demountable cleaning element capturing apparatus of this invention, one of which contains a brush cleaning element.

FIG. 1 shows a single heat exchange tube which supports a preferred embodiment of the demountable cleaning element capturing apparatus of this invention and which is exemplary of all of the tubes in a bundle that share common waterboxes in a steam condenser that is equipped with conventional means for reversing the flow of cooling water through the tubes.

Stainless steel heat exchange tube 1 is expanded and sealed into tube sheets 2 at each of its open ends 1*a*. Open end 3*a* of a tubular monolithic molded polypropylene adapter 3 is inserted into each of tube ends 1*a*, with the remainder of the adapter extending into a water box (not shown). Because of the fact that the inside diameter of the expanded tube end la may not be sufficiently uniform for a secure close tolerance press fit, it usually is desirable to firmly bond adapter end 3*a* in position with an epoxy or other water resistant cement (not shown). Since such cements generally adhere somewhat better to metal than to synthetic resin, the outside of adapter end 3*a* advantageously is provided with annular ridges 4 which insure a positive seal when the spaces between these ridges are filled with hardened cement. Such ridges also often can be used to effect a seal without cement when the end of a heat exchanger tube has been rolled to provide corresponding internal annular grooves (not shown).

The other open end 3*b* of adapter 3, which is provided with internal annular grooves 5, functions as the female element of a snap fastener that demountably couples adapter 3 to a tubular monolithic molded polypropylene cage 7. The male element of this snap fastener is open end 8 of cage 7, which has external annular ridges 6 that are retained by grooves 5.

Figure 2:
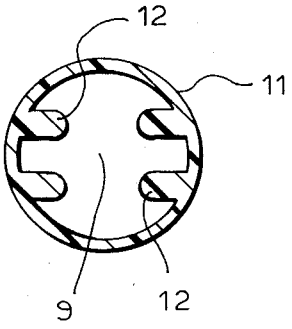
FIG. 2 is an end cross-section along line 2—2 of FIG. 1 showing restrictions within the cage of the cleaning element capturing apparatus.

Although the external diameter of ridges 6 is slightly larger than the internal diameter of adapter 3 immediately adjacent to grooves 5, the flexibility and resilience of the polypropylene permits cage end 8 to be snapped in or out by hand. There is little fluid pressure forcing this coupling open, as water exiting the tube can escape into a water box through open end 9 of tubular cage 7 and slots 10a separating longitudinal ribs 10. As shown in FIG. 2, open end 9 is restricted by protrusions 12 extending inward from solid wall 11 of the cage.

Returning to FIG. 1, the cleaning element shown in cage 7 at the left end of tube 1 is a conventional tube cleaning brush 13, in which non-absorbant nylon bristles 13*c* are held by twisted titanium wires 13*b* that are attached at their ends to molded polypropylene caps 13*a*. The diameter of the brush at the tip of bristles 13*c* is slightly larger than the inside diameter of the tube 1 to provide the scrubbing action necessary to keep the tube clean. The inside diameters of adapter 3 and cage 7 are less than the length of brush 13, so as to maintain it in alignment with the tube, and large enough to permit essentially unobstructed movement of brush 13 between tube 1 and cage 7. Brush 13 is prevented from escaping from cage 7 into the water box by longitudinal ribs 10 and protrusions 12 which are spaced apart to block passage by brush caps 13*a*.

As shown in FIG. 1, Brush 13 is in the position at which it would come to rest when cooling water is moving through tube 1 from right to left. Upon reversing that water flow, brush 13 is propelled into and through tube 1 and comes to rest in the cage 7 on the right side of the tube.

When one wishes to change a brush or to insert an electronic probe in the heat exchanger tube to test its integrity, it is necessary only to manually pull cage 7 out of adapter 3. This provides fast access to the interior of tube 1 with essentially no obstruction by adapter 3, which normally remains bonded to the tube and which functions as a cushion protecting both the end of the tube and any sensitive probe that is inserted. Replacement of cage 7 is equally simple, fast and safe.

Figure 3:
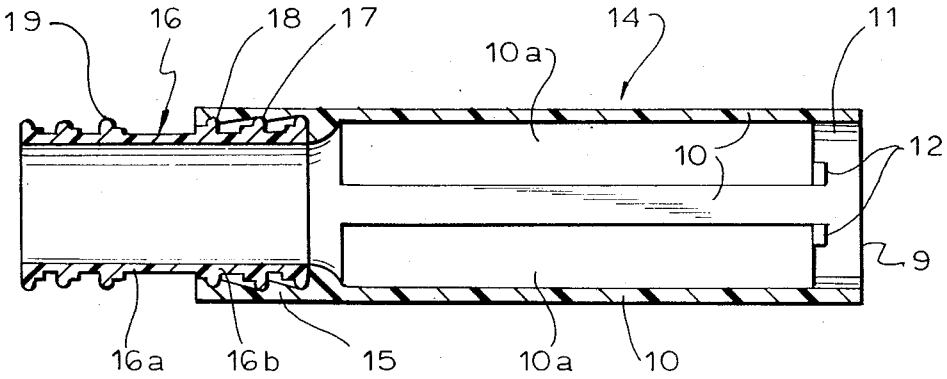
FIG. 3 is a longitudinal cross-section through another demountable cleaning element capturing apparatus of this invention

FIG. 3 illustrates another embodiment of this invention in which demountable coupling of an adapter 16 and a cage 14 is effected by adapter end 16*b*, which has external annular ridges 18 and functions as the male member of a snap fastener, and cage end 15, which has mating internal annular grooves and functions as the female member of that snap fastener. The other end of cage 14 is the same as that of cage 7, which is shown in FIGS. 1 and 2 and has been discussed above. Similarly, the tube coupling end of adapter 16 is the same as that of previously described adapter 3.

It will, of course, also be understood that various modifications and additions may be made in the preferred embodiments of this invention described above without departing from the spirit and scope of the invention as defined in the claims below. For example, while polypropylene is an especially preferred material of construction for both the cage and adapter, other resilient and water resistant materials, such as low and high density PE, PVC, polyesters, polyamides and ABS, also are suitable. Similarly, the lockable and easily dismountable coupling of cage and adapter, which is provided above by interlocking annular ridges and grooves, could be accomplished by interlocking bead-like protrusions and matching depressions, bayonet type connections, close tolerance press fit connections and other connecting means that can easily and quickly be uncoupled by hand without destruction of either the cage or adapter, but which are resistant to becoming uncoupled when subjected to the vibrations that normally occur in a heat exchanger. Other examples of such modifications include the use of other shape cage perforations, such as multiple round holes, and the use, in the cage, of other cleaning element retainers, such as a perforated disk or bar that partially blocks the cage opening distal from the heat exchanger tube.

We claim:

1. Apparatus for capturing a solid cleaning element that has been propelled by fluid pressure through a heat exchanger tube comprising a perforated tubular cage for catching said cleaning element and a tubular adapter for conveying said cleaning element between said heat exchanger tube and said cage.

said cage being made of a resilient synthetic polymer and having a first open end which is restricted to obstruct the passage of said cleaning element and a second open end through which said cleaning element can pass, said adapter being made of a resilient synthetic polymer and having a first open end adapted for fluid communication with said and bonding to the inside of heat exchanger tube and a second open end adapted for fluid communication with said second open cage end and said second open cage and adapter ends being mating elements of a demountable snap fastener.

2. Apparatus of claim 1 wherein said first adapter end is adapted for insertion into and bonding to the inside of an end of said heat exchange tube.

3. Apparatus of claim 1 wherein said second cage end is the male element of said snap fastener.

4. Apparatus of claim 1 wherein said second cage end is the female element of said snap fastener,

5. Apparatus of claim 1 wherein each of said cage and said adapter is a monolithic polypropylene molding.

6. Apparatus of claim 1 wherein one of said open cage and adapter ends is the male element of said snap fastener having an external lateral protrusion and the other of said open cage and adapter ends is the female element of said snap fastener having an internal depression for demountable retaining said protrusion.

7. Apparatus of claim 6 wherein said external protrusion on said male element is an annular ridge and said internal depression on said female element is an annular groove.

8. Apparatus of claim 7 wherein said male element has a plurality of said annular ridges and said female element has a plurality of said annular grooves.

9. Apparatus for capturing a solid cleaning element that has been propelled by fluid pressure through a heat exchanger tube comprising a tubular monolithic molded resilient synthetic polymer cage for catching said cleaning element and a tandemly positioned tubular monolithic molded resilient synthetic polymer adapter for conveying said cleaning element between said heat exchanger tube and said cage, said cage having a plurality of longitudinal slots in its wall, a first open end which is restricted to obstruct the passage of said cleaning element by at least one inward protrusion from said wall and a second open end through which said cleaning element can pass, said adapter having a first open end adapted for fluid communication with and bonding to the interior surface of an end of said heat exchanger tube and a second open end adapted for fluid communication with said second open cage end, and one of said second open cage and adapter ends being the male element of a demountably lockable fluid coupling and the other of said second ends being the mating female element of said fluid coupling.

10. Apparatus of claim 9 wherein each of said cage and adapter is made of polypropylene.

11. Apparatus of claim 10 wherein said male coupling element has an external lateral protrusion and said female coupling element has an internal depression for retaining said protrusion.

12. Apparatus of claim 11 wherein said male coupling element has a plurality of external annular ridges and said female coupling element has a plurality of internal annular grooves for retaining said ridges.

13. Apparatus of claim 12 wherein said second open adapter and is said male element.

14. Apparatus of claim 12 wherein said second open cage end is said male element.

15. In a heat exchanger having a plurality of heat exchanger tubes extending between fluid reservoirs common to said tubes and means for reversing the fluid flow in said tubes, cleaning means comprising a cleaning element in each said tube and, at each end of each said tube, a tandemly positioned tubular resilient synthetic polymer cage for catching said cleaning element and an intermediate resilient synthetic polymer adapter for conveying said cleaning element between said heat exchanger tube and said cage, said cage having a plurality of lingitudinal slots in its wall, a first open end which is restricted to obstruct the passage of said cleaning element by at least one inward protrusion from said wall and a second open end through which said cleaning element can pass, said adapter having a first open end in fluid communication with and bonded to the interior surface of an end of said heat exchanger tube and a second open end in fluid communication with to said second open cage end and said second open cage and adapter ends being mating elements of a demountable snap fastener.

16. The heat exchanger of claim 15, wherein one of said second open cage and adapter ends is a male fluid coupling having an external lateral protrusion and the other of said second ends is a mating female fluid coupling having an internal depression for retaining said protrusion.

17. The heat exchanger of claim 16, wherein said internal depression is an annular groove and said external protrusion is an annular ridge.

* * * * *